US006575417B1

(12) United States Patent
Krommenakker

(10) Patent No.: US 6,575,417 B1
(45) Date of Patent: Jun. 10, 2003

(54) BEVERAGE CONTAINER HOLDING DEVICE

(76) Inventor: John S. Krommenakker, 6611 Lenox Ave., Wisconsin Rapids, WI (US) 54494

( * ) Notice: Subject to any disclaimer, the term of this patent is extended or adjusted under 35 U.S.C. 154(b) by 0 days.

(21) Appl. No.: 10/028,106

(22) Filed: Dec. 21, 2001

(51) Int. Cl.[7] ..... A47K 1/08
(52) U.S. Cl. ..... 248/311.2; 248/151; 248/156
(58) Field of Search ..... 248/156, 311.2, 248/314, 151, 150; 47/47, 41.14

(56) References Cited

U.S. PATENT DOCUMENTS

| | | | | | |
|---|---|---|---|---|---|
| 706,176 | A | * | 8/1902 | Hassett | 248/125.8 |
| 763,962 | A | * | 7/1904 | Clayton | 220/605 |
| 1,448,808 | A | * | 3/1923 | McGowan | 119/786 |
| 2,643,843 | A | * | 6/1953 | Brown | 248/156 |
| 3,033,502 | A | * | 5/1962 | Silver | 24/115 N |
| 3,221,957 | A | * | 12/1965 | Roloff et al. | 211/60.1 |
| 3,279,733 | A | * | 10/1966 | Hannan | 248/153 |
| 3,840,204 | A | * | 10/1974 | Thomas et al. | 131/241 |
| 4,334,661 | A | | 6/1982 | Pitt | |
| 4,878,642 | A | * | 11/1989 | Kirby, Jr. | 248/230.1 |
| 4,938,446 | A | * | 7/1990 | Williams | 248/530 |
| 5,052,649 | A | * | 10/1991 | Hunnicutt | 224/926 |
| 5,065,975 | A | * | 11/1991 | Giles | 232/39 |
| 5,294,083 | A | | 3/1994 | Roth | |
| 5,375,801 | A | | 12/1994 | Porter | |
| D366,600 | S | | 1/1996 | Laskowski et al. | |
| 5,570,863 | A | | 11/1996 | Cooper | |
| 5,674,108 | A | * | 10/1997 | Rolle | 451/38 |
| 5,819,720 | A | * | 10/1998 | Schubert | 126/25 R |
| 5,823,496 | A | | 10/1998 | Foley et al. | |
| 6,015,122 | A | * | 1/2000 | Qui | 248/156 |

* cited by examiner

*Primary Examiner*—Korie Chan

(57) ABSTRACT

A beverage container holding device for holding a beverage container. The beverage container holding device includes a body member being designed for holding the beverage container. The body member has a perimeter wall. The perimeter wall defines an interior space of the body member. The interior space of the body member has an open end for permitting insertion of the beverage container into the interior space of the body member. A support member is coupled to the body member. The body member has a free end. The free end of the support member is positioned opposite the body member. The free end is designed for being inserted into the ground whereby the support member supports the body member above the ground when the free end of the support member is inserted into the ground.

1 Claim, 4 Drawing Sheets

BEVERAGE CONTAINER HOLDING DEVICE

BACKGROUND OF THE INVENTION

1. Field of the Invention

The present invention relates to beverage holder assemblies and more particularly pertains to a new beverage container holding device for holding a beverage container.

2. Description of the Prior Art

The use of beverage holder assemblies is known in the prior art. U.S. Pat. No. 5,823,496 describes a device for engaging the ground and holding a beverage for a user. Another type of beverage holder assembly is U.S. Pat. No. 5,570,863 having a tubing forming a spiraled liquid container holder with a lower portion that is inserted into the ground for supporting the liquid being used by the user. U.S. Pat. No. 5,375,801 has a post that is inserted into the ground and supports a sign. U.S. Pat. No. 5,294,083 has a hollow drink holder having a stake for engaging the ground to hold a drink container and hook member coupled to the stake for engaging the corner of a beach blanket. U.S. Pat. No. 4,334,661 having a ground stake with a drink container supporting foot and a ring for supporting a drink container. U.S. Pat. No. Des. 366,600 showing a combined beverage container and blanket/towel spike.

While these devices fulfill their respective, particular objectives and requirements, the need remains for a device that includes certain improved features that inhibits thermal transfer between a drink container and the environment.

SUMMARY OF THE INVENTION

The present invention meets the needs presented above by providing the perimeter wall of the with an insulating interior portion for inhibiting thermal transfer between the beverage container and the environment.

Still yet another object of the present invention is to provide a new beverage container holding device that supports a drink container for a user while the user is outside.

Even still another object of the present invention is to provide a new beverage container holding device that has apertures for draining the interior space when the interior space becomes filled with fluid.

To this end, the present invention generally comprises a body member being designed for holding the beverage container. The body member has a perimeter wall. The perimeter wall defines an interior space of the body member. The interior space of the body member has an open end for permitting insertion of the beverage container into the interior space of the body member. A support member is coupled to the body member. The body member has a free end. The free end of the support member is positioned opposite the body member. The free end is designed for being inserted into the ground whereby the support member supports the body member above the ground when the free end of the support member is inserted into the ground.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
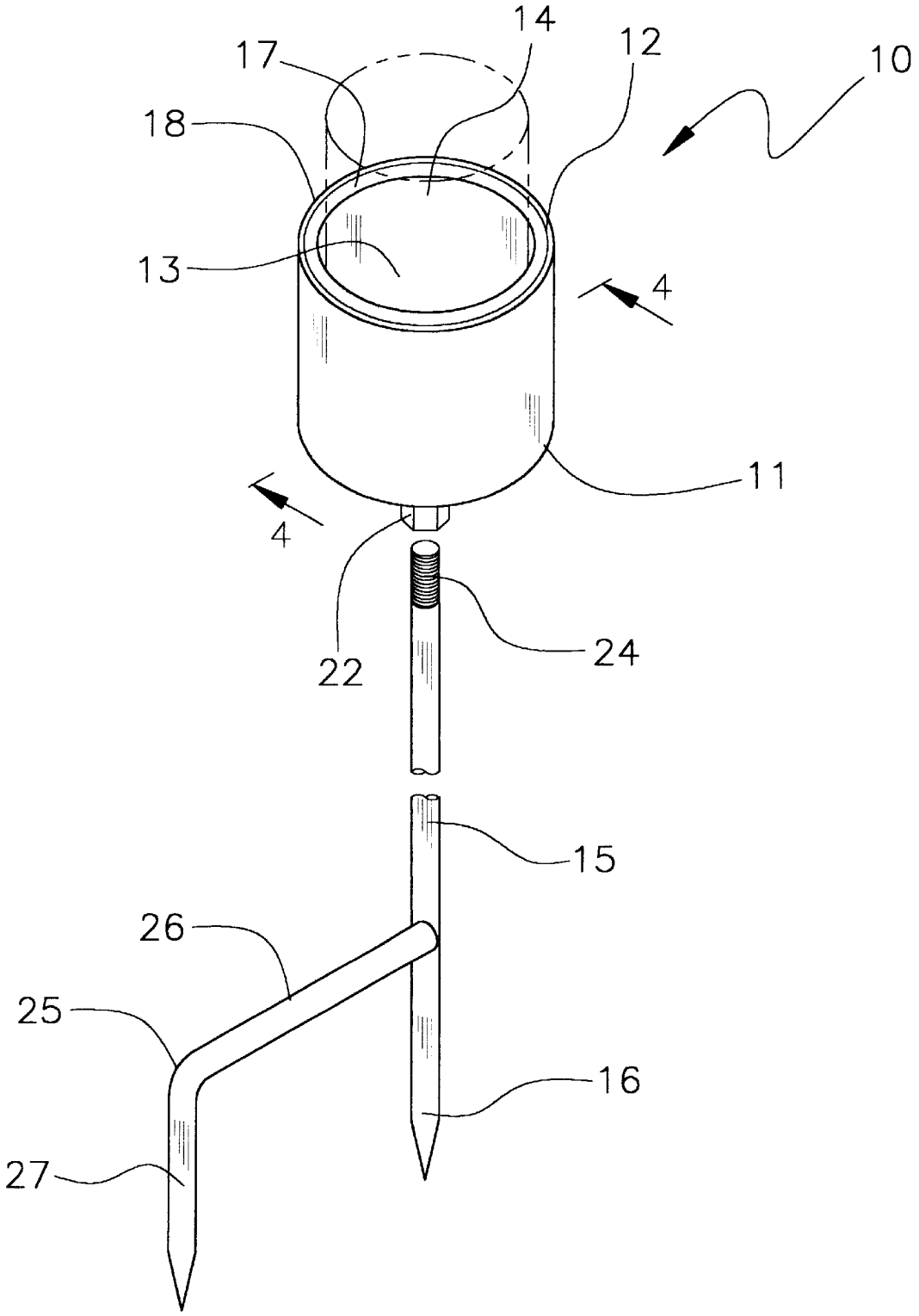
FIG. 1 is an exploded poerspective view of a new beverage container holding device according to the present invention.
Figure 2:
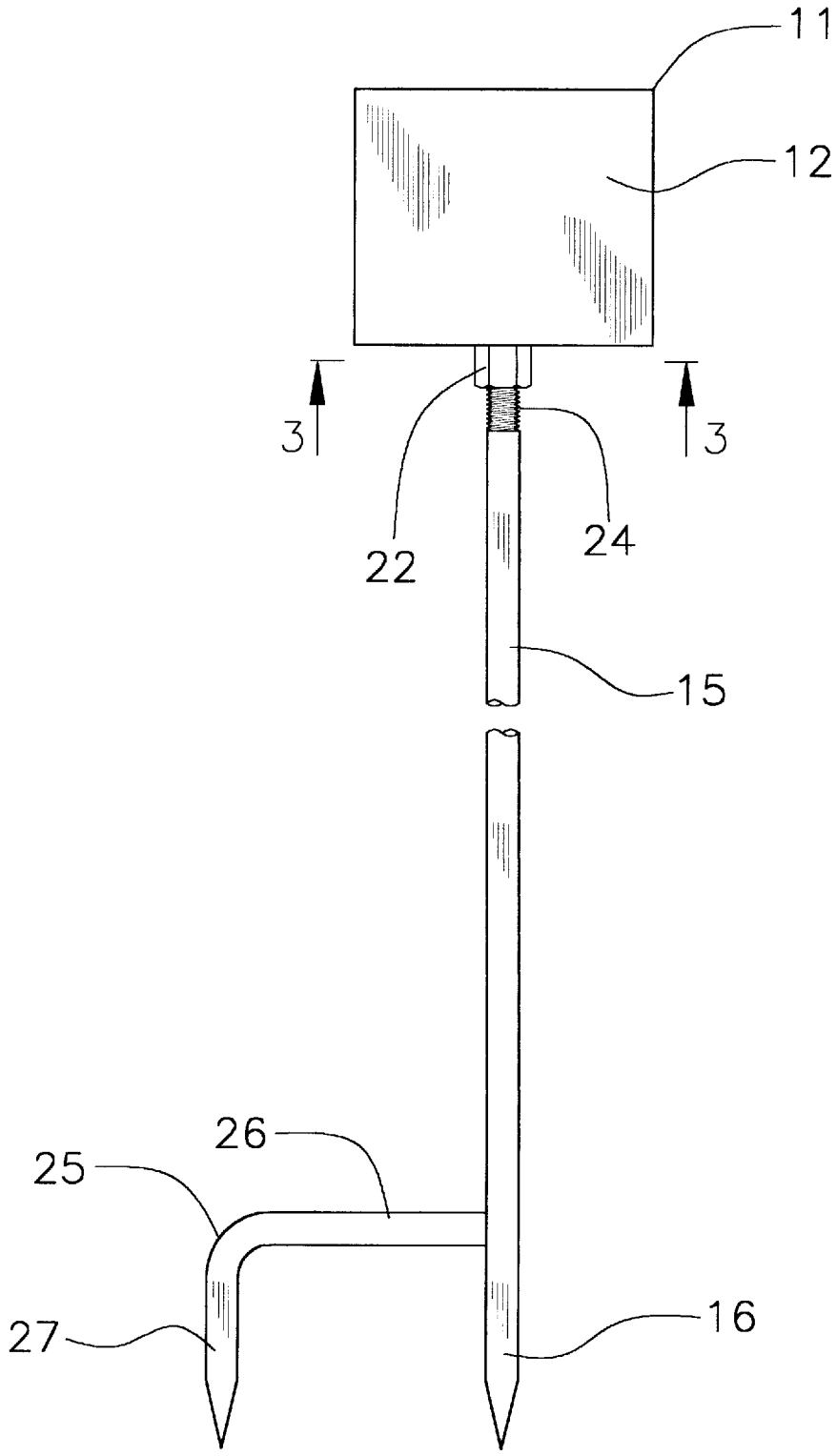
FIG. 2 is a side view of the present invention.
Figure 3:
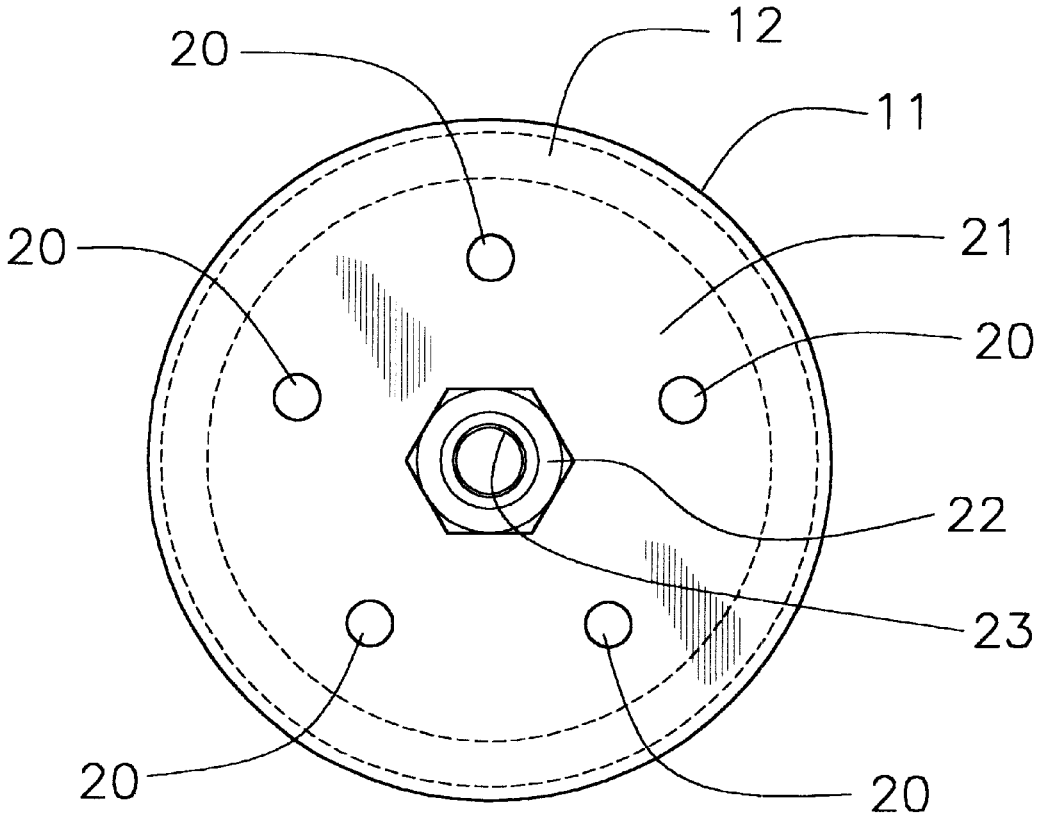
FIG. 3 is a bottom view of the body member of the present invention.
Figure 4:
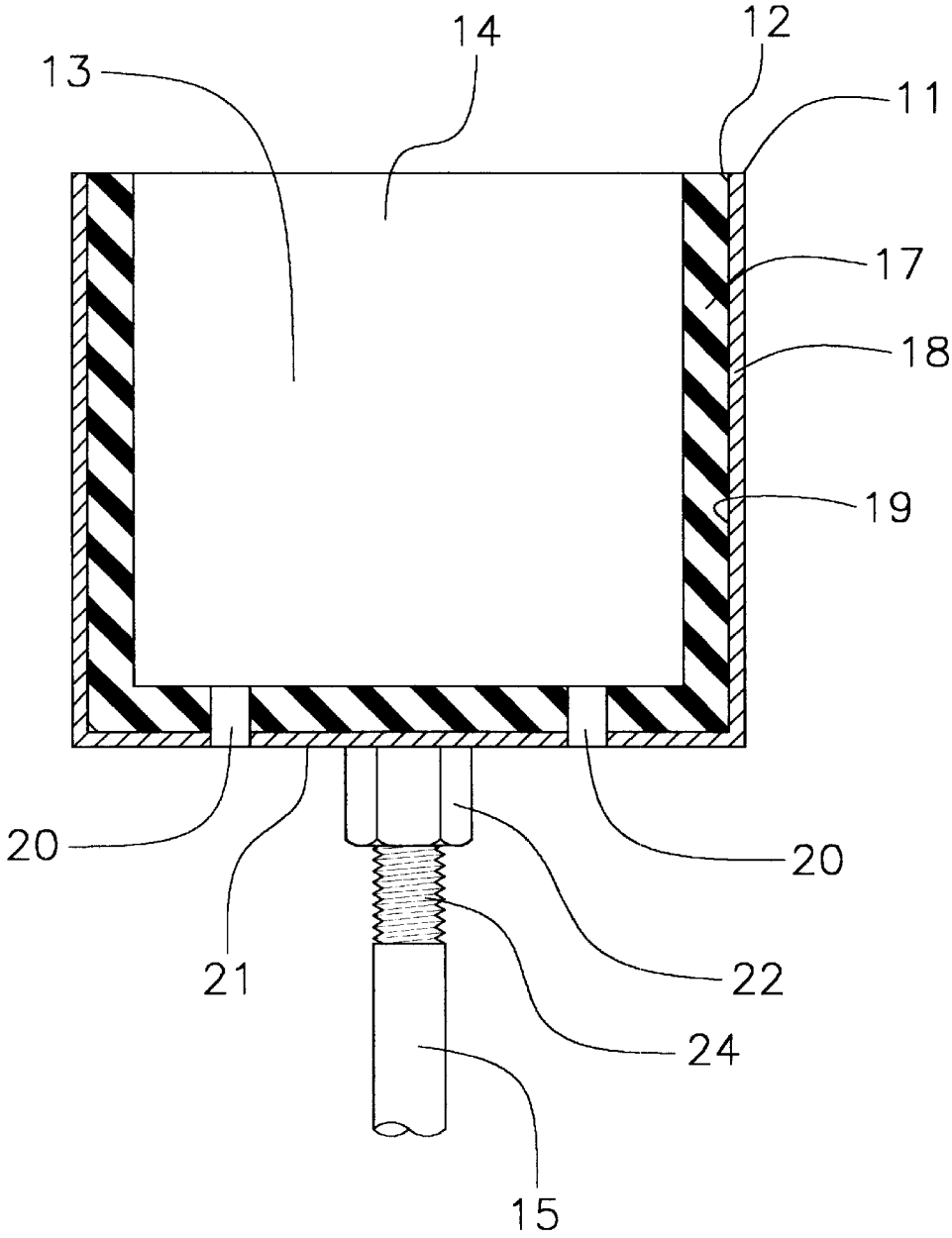
FIG. 4 is a cross-sectional view of the present invention taken along line 4—4 of FIG. 1.

With reference now to the drawings, and in particular to FIGS. 1 through 4 thereof, a new beverage container holding device embodying the principles and concepts of the present invention and generally designated by the reference numeral 10 will be described.

As best illustrated in FIGS. 1 through 4, the beverage container holding device 10 generally comprises a body member 11 being designed for holding the beverage container. The body member 11 has a perimeter wall 12. The perimeter wall 12 defines an interior space 13 of the body member 11. The interior space 13 of the body member 11 has an open end 14 for permitting insertion of the beverage container into the interior space 13 of the body member 11. The body member 11 has height of about 3 inches and a diameter of about 3½ inches.

A support member 15 is coupled to the body member 11. The body member 11 has a free end 16. The free end 16 of the support member 15 is positioned opposite the body member 11. The free end 16 is designed for being inserted into the ground whereby the support member 15 supports the body member 11 above the ground when the free end 16 of the support member 15 is inserted into the ground. The support member 15 has length of about 33 inches and a diameter of about ⅜ inch.

The perimeter wall 12 of the body member 11 has an interior portion 17 and an exterior portion 18. The interior portion 17 is coupled to an interior face 19 of the exterior portion 18 whereby the interior portion 17 abuts the beverage container when the beverage container is positioned in the interior space 13 of the body member 11. The interior portion 17 of the perimeter wall 12 of the body member 11 comprises an insulating material. The insulating material is designed for inhibiting thermal communication between the beverage container and the environment when the beverage container is positioned in the interior space 13 of the body member 11.

The perimeter wall 12 of the body member 11 has a plurality of apertures 20. Each of the apertures 20 extends through a bottom wall 21 of the perimeter wall 12. Each of the apertures 20 is designed for permitting liquid collected in the interior space 13 of the body member 11 to drain.

The body member 11 has a coupler portion 22. The coupler portion 22 selectively receives the support member 15 for coupling the body member 11 to the support member 15. The coupler portion 22 of the body member 11 has a threaded bore 23. The threaded bore 23 of the coupler portion 22 threadably receives a threaded end 24 of the body member 11.

An anchor member 25 is coupled to the support member 15. The anchor member 25 is designed for engaging the ground whereby the anchor member 25 is for inhibiting rotation of the support member 15 with respect to the ground when the anchor member 25 and the support member 15 engage the ground. The anchor member 25 has a base arm 26 and an engaging arm 27. The base arm 26 orthogonally extends from the support member 15. The engaging arm 27 is positioned at a distal end of the base arm 26 whereby the engaging arm 27 is positioned in a spaced relation to the support member 15.

In use, the user couples the body member 11 to the support member 15. The support member 15 and anchor member 25 are then pushed into the ground. The user can then put a beverage container into the interior space 13 of the body member 11 so that the body member 11 holds the beverage container when the user is otherwise occupied.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage container holding device for holding a beverage container for a user, the beverage holding device comprising:

a body member being adapted for holding the beverage container, said body member having a perimeter wall, said perimeter wall defining an interior space of said body member, said interior space of said body member having an open end for permitting insertion of the beverage container into said interior space of said body member;

a support member being coupled to said body member, said support member having a free end, said free end of said support member being positioned opposite said body member, said free end being adapted for being inserted into the ground such that said support member supports said body member above the ground when said free end of said support member is inserted into the ground;

said perimeter wall of said body member having an interior portion and an exterior portion, said interior portion being coupled to an interior face of said exterior portion such that said interior portion abuts the beverage container when the beverage container is positioned in said interior space of said body member;

said interior portion of said perimeter wall of said body member comprising an insulating material, said insulating material being adapted for inhibiting thermal communication between the beverage container and the environment when the beverage container is positioned in said interior space of said body member;

said perimeter wall of said body member having a plurality of apertures, each of said apertures extending through a bottom wall of said perimeter wall, each of said apertures being adapted for permitting liquid collected in said interior space of said body member to drain;

said body member having a coupler portion, said coupler portion outwardly extending from said bottom wall of said perimeter wall of said body member, said coupler portion selectively receiving said support member for coupling said body member to said support member such that said bottom wall of said perimeter wall inhibits communication between said coupler portion and said interior space of said body member;

said coupler portion of said body member having a threaded bore, said threaded bore of the coupler portion threadably receiving a threaded end of said support member;

an anchor member being coupled to said support member, said anchor member being adapted for engaging the ground such that said anchor member is for inhibiting rotation of said support member with respect to the ground when said anchor member and said support member engage the ground; and said anchor member having a base arm and an engaging arm, said base arm orthogonally extending from said support member, said engaging arm being positioned at a distal end of said base arm such that said engaging arm is positioned in a spaced relation to said support member;

wherein said engaging arm of said anchor member extends a distance from the base arm to a free distal end of said engaging arm.

* * * * *